US007428803B2

(12) United States Patent
Wenstrup et al.

(10) Patent No.: US 7,428,803 B2
(45) **Date of Patent: *Sep. 30, 2008**

(54) CEILING PANEL SYSTEM WITH NON-WOVEN PANELS HAVING BARRIER SKINS

(75) Inventors: David E. Wenstrup, Greer, SC (US); Gregory J. Thompson, Simpsonville, SC (US); Raymond C. Sturm, Spartanburg, SC (US); Thomas E. Godfrey, Moore, SC (US)

(73) Assignee: Milliken & Company, Spartanburg, SC (US)

( * ) Notice: Subject to any disclaimer, the term of this patent is extended or adjusted under 35 U.S.C. 154(b) by 128 days.

This patent is subject to a terminal disclaimer.

(21) Appl. No.: 11/528,309

(22) Filed: Sep. 27, 2006

(65) Prior Publication Data

US 2007/0056234 A1 Mar. 15, 2007

Related U.S. Application Data

(63) Continuation-in-part of application No. 11/130,749, filed on May 17, 2005, now Pat. No. 7,341,963.

(51) Int. Cl.
*E04B 9/24* (2006.01)
*B32B 7/02* (2006.01)
*D04H 5/06* (2006.01)

(52) U.S. Cl. ..... 52/506.07; 52/309.1; 442/411; 442/415; 428/218

(58) Field of Classification Search ..... 52/220, 52/6, 506.07, 309.1, 220.6; 442/389, 409, 442/411, 414, 415, 212; 428/218, 212
See application file for complete search history.

(56) References Cited

U.S. PATENT DOCUMENTS 2,500,282 A 3/1950 Francis, Jr. ..... 154/101

(Continued)

FOREIGN PATENT DOCUMENTS

DE 202 03 427 4/2003

(Continued)

OTHER PUBLICATIONS

Additives—Reinforcing Polypropylene with Natural Fibers. Plastics Engineering / Apr. 1994. Anand R. Sanadi—Department of Forestry, University of Wisconsin, Madison, Wisconsin. Daniel F. Caulfield and Roger M. Rowell, Forest Products Laboratory—U.S. Department of Agriculture, Madison, Wisconsin.

(Continued)

*Primary Examiner*—Gay Ann Spahn
(74) *Attorney, Agent, or Firm*—Cheryl J. Brickey

(57) ABSTRACT

A ceiling system having panels suspended from a ceiling with a frame and suspension connections. The panels are a non-woven material including first effect fibers, first binder fibers, second binder fibers, and second effect fibers. The non-woven material has a first planar zone and a second planar zone. The first planar zone includes a greater concentration of first effect fibers and first binder fibers. The second planar zone includes a greater concentration of second effect fibers and second binder fibers. The first planar zone can include a first surface skin associated with the first planar zone on the exterior of the non-woven material, and a second surface skin associated with the second planar zone on the exterior of the non-woven material.

1 Claim, 3 Drawing Sheets

U.S. PATENT DOCUMENTS

| | | | | |
|---|---|---|---|---|
| 2,543,101 | A | 2/1951 | Francis, Jr. | 154/101 |
| 3,041,703 | A | 7/1962 | Prell | 26/51.5 |
| 3,073,735 | A | 1/1963 | Till et al. | 156/38 |
| 3,254,300 | A | 5/1966 | Prell | 324/68 |
| 3,688,804 | A | 9/1972 | Brown et al. | 139/1 |
| 3,740,797 | A | 6/1973 | Farrington | 19/156.3 |
| 3,772,739 | A | 11/1973 | Lovgren | 19/156.3 |
| 3,837,995 | A | 9/1974 | Floden | 161/150 |
| 4,018,646 | A | 4/1977 | Ruffo et al. | 162/146 |
| 4,082,886 | A | 4/1978 | Butterworth et al. | 428/284 |
| 4,127,698 | A | 11/1978 | Shimizu et al. | 428/373 |
| 4,194,037 | A | 3/1980 | Stoller | 429/92 |
| 4,418,031 | A | 11/1983 | Doerer et al. | 264/241 |
| 4,435,468 | A | 3/1984 | TenEyck | 428/285 |
| 4,474,846 | A | 10/1984 | Doerer et al. | 428/284 |
| 4,568,581 | A | 2/1986 | Peoples, Jr. | 428/35 |
| 4,666,763 | A | 5/1987 | King et al. | 428/221 |
| 4,714,647 | A | 12/1987 | Shipp, Jr. et al. | 428/212 |
| 4,840,832 | A | 6/1989 | Weinle et al. | 428/156 |
| 4,863,797 | A | 9/1989 | Ichibori et al. | 428/359 |
| 4,931,357 | A | 6/1990 | Marshall et al. | 442/415 |
| 4,970,111 | A | 11/1990 | Smith, Jr. | 428/283 |
| 5,001,331 | A | 3/1991 | Leestemaker | 235/375 |
| 5,039,431 | A | 8/1991 | Johnson et al. | 264/113 |
| 5,079,074 | A | 1/1992 | Steagall et al. | 428/218 |
| 5,108,678 | A | 4/1992 | Hirasaka et al. | 264/113 |
| 5,141,805 | A | 8/1992 | Nohara et al. | 428/296 |
| 5,147,345 | A | 9/1992 | Young et al. | 604/378 |
| 5,173,355 | A | 12/1992 | Vock et al. | 428/219 |
| 5,182,060 | A | 1/1993 | Berecz | 264/70 |
| 5,200,128 | A | 4/1993 | Kiss | 264/113 |
| 5,208,105 | A | 5/1993 | Ichibori et al. | 428/373 |
| 5,348,796 | A | 9/1994 | Ichibori et al. | 442/202 |
| 5,350,624 | A | 9/1994 | Georger et al. | 429/219 |
| 5,399,423 | A | 3/1995 | McCullough et al. | 428/287 |
| 5,407,739 | A | 4/1995 | McCullough et al. | 428/287 |
| 5,409,573 | A | 4/1995 | Weeks | 162/145 |
| 5,458,960 | A | 10/1995 | Nieminen et al. | 428/284 |
| 5,508,102 | A | 4/1996 | Georger et al. | 428/297 |
| 5,537,718 | A | 7/1996 | Nagatsuka et al. | 19/302 |
| 5,558,832 | A | 9/1996 | Noel et al. | 264/510 |
| 5,571,604 | A | 11/1996 | Sprang et al. | 428/212 |
| 5,578,368 | A | 11/1996 | Forsten et al. | 428/229 |
| 5,591,289 | A | 1/1997 | Souders et al. | 156/148 |
| 5,614,285 | A | 3/1997 | Gardill | 428/156 |
| 5,679,296 | A | 10/1997 | Kelman et al. | 264/71 |
| 5,685,347 | A | 11/1997 | Graham et al. | 139/390 |
| 5,698,298 | A | 12/1997 | Jackson et al. | 428/198 |
| 5,723,209 | A | 3/1998 | Borger et al. | 428/219 |
| 5,733,635 | A | 3/1998 | Terakawa et al. | 428/198 |
| 5,766,745 | A | 6/1998 | Smith et al. | 428/218 |
| 5,817,408 | A | 10/1998 | Orimo et al. | 428/218 |
| 5,832,685 | A * | 11/1998 | Hermanson | 52/506.07 |
| 5,856,243 | A | 1/1999 | Geirhos et al. | 442/57 |
| 5,873,392 | A | 2/1999 | Meyer et al. | 139/113 |
| 5,916,507 | A | 6/1999 | Dabi et al. | 264/113 |
| 5,942,288 | A | 8/1999 | Kajander | 427/389.7 |
| 6,063,461 | A | 5/2000 | Hoyle et al. | 428/34.5 |
| 6,066,388 | A | 5/2000 | Van Kerrebrouck | 428/218 |
| 6,074,505 | A | 6/2000 | Ouellette et al. | 156/148 |
| 6,110,848 | A | 8/2000 | Bouchette | 442/384 |
| 6,127,021 | A | 10/2000 | Kelman | 428/172 |
| 6,177,370 | B1 | 1/2001 | Skoog et al. | 442/387 |
| 6,204,207 | B1 | 3/2001 | Cederblad et al. | 442/5 |
| 6,271,270 | B1 | 8/2001 | Muzzy et al. | 521/48 |
| 6,322,658 | B1 | 11/2001 | Byma et al. | 156/309.9 |
| 6,346,491 | B1 | 2/2002 | DeAngelis et al. | 442/110 |
| 6,364,976 | B2 | 4/2002 | Fletemier et al. | 156/62.2 |
| 6,475,315 | B1 | 11/2002 | Kean et al. | 156/62.2 |
| 6,494,362 | B1 | 12/2002 | Harmon | 235/375 |
| 6,572,723 | B1 | 6/2003 | Tilton et al. | 156/219 |
| 6,582,639 | B2 | 6/2003 | Nellis | 264/119 |
| 6,586,353 | B1 | 7/2003 | Kiik et al. | 442/320 |
| 6,609,261 | B1 | 8/2003 | Mortensen et al. | 5/698 |
| 6,610,904 | B1 | 8/2003 | Thomas et al. | 604/383 |
| 6,689,242 | B2 | 2/2004 | Bodaghi | 156/181 |
| 6,702,914 | B2 | 3/2004 | North et al. | 156/228 |
| 6,718,583 | B1 | 4/2004 | Diaz | 5/698 |
| 6,734,335 | B1 | 5/2004 | Graef et al. | 604/365 |
| 6,736,915 | B2 | 5/2004 | Gebreselassie et al. | 156/62.6 |
| 6,756,332 | B2 | 6/2004 | Sandoe et al. | 442/344 |
| 6,764,971 | B2 | 7/2004 | Kelly et al. | 442/408 |
| 6,774,068 | B2 | 8/2004 | Park | 442/326 |
| 6,781,027 | B2 | 8/2004 | Fenwick et al. | 604/365 |
| 6,797,653 | B2 | 9/2004 | Fay | 442/85 |
| 6,823,458 | B1 | 11/2004 | Lee et al. | 726/16 |
| 6,936,554 | B1 | 8/2005 | Singer | 442/327 |
| 7,137,477 | B2 | 11/2006 | Keller et al. | 181/286 |
| 2001/0037854 | A1 | 11/2001 | Byma et al. | 156/309.9 |
| 2003/0087572 | A1 | 5/2003 | Balthes et al. | 442/247 |
| 2003/0100239 | A1 | 5/2003 | Gaffney et al. | 442/354 |
| 2003/0106560 | A1 | 6/2003 | Griesbach et al. | 128/849 |
| 2003/0162461 | A1 | 8/2003 | Balthes | 442/411 |
| 2003/0199216 | A1 | 10/2003 | Gomez et al. | 442/327 |
| 2003/0200991 | A1 | 10/2003 | Keck et al. | 134/6 |
| 2003/0224145 | A1 | 12/2003 | Campion et al. | 428/171 |
| 2003/0224679 | A1 | 12/2003 | Ahluwalia | 442/72 |
| 2003/0228460 | A1 | 12/2003 | Ahluwalia | 428/315.5 |
| 2004/0023586 | A1 | 2/2004 | Tilton | 442/381 |
| 2004/0060118 | A1 | 4/2004 | Diaz | 5/698 |
| 2004/0060119 | A1 | 4/2004 | Murphy et al. | 5/698 |
| 2004/0062912 | A1 | 4/2004 | Mason et al. | 428/139 |
| 2004/0091705 | A1 | 5/2004 | Hanyon et al. | 428/373 |
| 2004/0097159 | A1 | 5/2004 | Balthes et al. | 442/415 |
| 2004/0102112 | A1 | 5/2004 | McGuire et al. | 442/59 |
| 2004/0106347 | A1 | 6/2004 | McGuire et al. | 442/361 |
| 2004/0158928 | A1 | 8/2004 | Gladney | 5/698 |
| 2004/0185239 | A1 | 9/2004 | Nakamura et al. | 428/292.4 |
| 2004/0185731 | A1 | 9/2004 | McGuire | 442/141 |
| 2004/0198125 | A1 | 10/2004 | Mater et al. | 442/394 |
| 2004/0235983 | A1 | 11/2004 | Stadler et al. | 523/122 |
| 2004/0242107 | A1 | 12/2004 | Collins | 442/403 |
| 2004/0242109 | A9 | 12/2004 | Tilton et al. | 442/415 |
| 2004/0259451 | A1 | 12/2004 | Paradis et al. | 442/381 |
| 2005/0020164 | A1 | 1/2005 | Nakamura et al. | 442/181 |
| 2005/0023509 | A1 | 2/2005 | Bascom et al. | 252/608 |
| 2005/0026527 | A1 | 2/2005 | Schmidt et al. | 442/381 |
| 2005/0026528 | A1 | 2/2005 | Forsten et al. | 442/414 |
| 2005/0148268 | A1 | 7/2005 | Tai | 442/414 |
| 2005/0170726 | A1 | 8/2005 | Brunson et al. | 442/327 |
| 2005/0170728 | A1 | 8/2005 | Crainic | 442/327 |
| 2005/0176327 | A1 * | 8/2005 | Wenstrup et al. | 442/357 |
| 2006/0063458 | A1 | 3/2006 | McGuire | 442/411 |
| 2006/0068675 | A1 | 3/2006 | Handermann et al. | 442/415 |
| 2006/0099393 | A1 | 5/2006 | Woodman et al. | 428/292.1 |
| 2006/0105661 | A1 | 5/2006 | Steinback | 442/327 |
| 2006/0111003 | A1 | 5/2006 | Balthes | 442/337 |
| 2006/0178064 | A1 | 8/2006 | Balthes et al. | 442/59 |
| 2006/0182940 | A1 | 8/2006 | Cline | 428/292.1 |
| 2006/0252323 | A1 | 11/2006 | Cline | 442/71 |
| 2006/0264142 | A1 | 11/2006 | Wenstrup et al. | 442/71 |
| 2007/0042658 | A1 | 2/2007 | Cline et al. | 442/136 |
| 2007/0042665 | A1 | 2/2007 | Peng et al. | 442/389 |

FOREIGN PATENT DOCUMENTS

| | | |
|---|---|---|
| EP | 0393450 | 9/1993 |
| EP | 0 622 332 | 7/1998 |
| EP | 1 300 511 | 4/2003 |
| EP | 1400328 | 3/2004 |
| JP | 59 186750 | 10/1984 |
| JP | 59192754 | 6/1992 |
| JP | 06200460 | 7/1994 |
| JP | 08108439 | 4/1996 |

| | | |
|---|---|---|
| JP | 08323903 | 12/1996 |
| JP | 09216303 | 8/1997 |
| JP | 09220784 | 8/1997 |
| JP | 09313832 | 12/1997 |
| JP | 10 095060 | 4/1998 |
| JP | 10110371 | 4/1998 |
| JP | 10147191 | 6/1998 |
| JP | 10180023 | 7/1998 |
| JP | 10236204 | 9/1998 |
| JP | 10236205 | 9/1998 |
| JP | 10236238 | 9/1998 |
| JP | 10245760 | 9/1998 |
| JP | 11058571 | 3/1999 |
| JP | 11061616 | 3/1999 |
| JP | 11217756 | 8/1999 |
| JP | 11268596 | 10/1999 |
| JP | 2000/211417 | 8/2000 |
| JP | 2001/232708 | 8/2001 |
| JP | 2002/526296 | 8/2002 |
| JP | 2002/287767 | 10/2002 |
| JP | 2003/305789 | 10/2003 |
| JP | 2004/524453 | 8/2004 |
| JP | 2004/346436 | 12/2004 |
| JP | 2004 353110 | 12/2004 |
| JP | 2004/360089 | 12/2004 |
| JP | 2005/053035 | 3/2005 |
| WO | WO 02/076630 | 10/2002 |
| WO | WO 2005/066396 | 7/2005 |
| WO | WO 2005/110733 | 11/2005 |
| WO | WO 2006/083144 | 8/2006 |
| WO | WO 2006/091031 | 8/2006 |
| WO | WO 2006/124305 | 11/2006 |

OTHER PUBLICATIONS

1995 American Chemical Society. Ind. Eng. Chem. Res. 1995, 34, 1889-1896. Renewable Agricultural Fibers as Reinforcing Fillers in Plastics: Mechanical Properties of Kenaf Fiber-Polypropylene Composites. Anand R. Sanadi, Daniel F. Caulfield, Rodney E. Jacobson, and Roger M. Rowell. Department of Forestry, University of Wisconsin, 1630 Linden Drive, Madison, Wisconsin 53706, and Forest Products Laboratory, USDA, 1 Gifford Pinchot Drive, Madison, Wisconsin 53705.

National Renewable Energy Laboratory, Golden, Colorado. Proceedings—Second Biomass Conference of the Americas: Energy, Environment, Agriculture, and Industry. Aug. 21-24, 1995, Portland, Oregon.

Science and Technology of Polymers and Advanced Materials. Edited by P.N. Prasad et al., Plenum Press, New York, 1998. Property Enhanced Natural Fiber Composite Materials Based on Chemical Modification. Roger M. Rowell. USDA Forest Service, Forest Products Laboratory, One Gifford Pinchot Drive, Madison, WI 53705-2366 and Department of Biological Systems Engineering, University of Wisconsin, Madison, WI 63706.

Science and Technology of Polymers and Advanced Materials Edited by P.N. / Prasad et al., Plenum Press, New York, 1998. Economic Opportunities in Natural Fiber-Thermoplastic Composites. Roger M. Rowell. USDA Forest Products Laboratory, One Gifford Pinchot Drive, Madison, WI 53705-2366 and Department of Biological Systems Engineering, University of Wisconsin, Madison, WI 63706.

Plastics Technology Online Article—Natural Fibers: The New Fashion in Automotive Plastics—Oct. 1999. By Lilli Manolis Sherman, Senior Editor.

"Rieter Ultra Light™, A weight saving breakthrough in vehicle acoustics," Rieter Automotive Management AG 110.9e-AA-9/US.

* cited by examiner

CEILING PANEL SYSTEM WITH NON-WOVEN PANELS HAVING BARRIER SKINS

CROSS REFERENCE TO RELATED APPLICATION

This application claims priority and CIP to U.S. application Ser. No. 11/130,749 now U.S. Pat. No. 7,341,963, entitled "Non-Woven Material With Barrier Skin", filed on May 17, 2005, by inventors David Wenstrup and Gregory Thompson which is hereby incorporated in its entirety by specific reference thereto.

BACKGROUND

The present invention generally relates to ceiling systems, and in particular, ceiling systems using non-woven panels.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
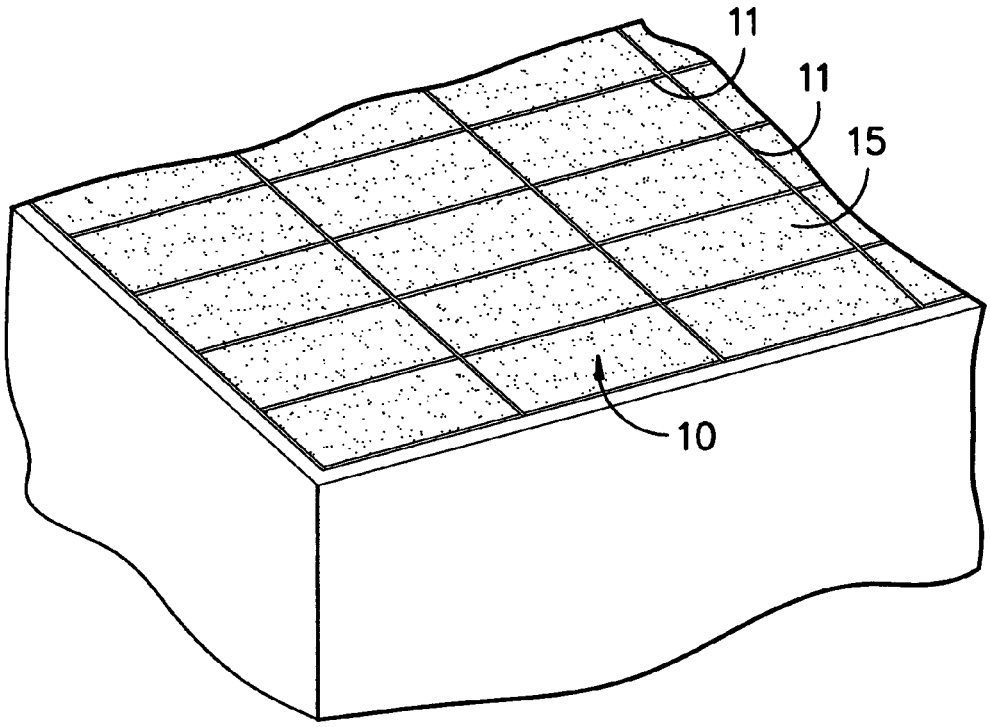
FIG. 1 shows a view of the ceiling system of the present invention
Figure 2:
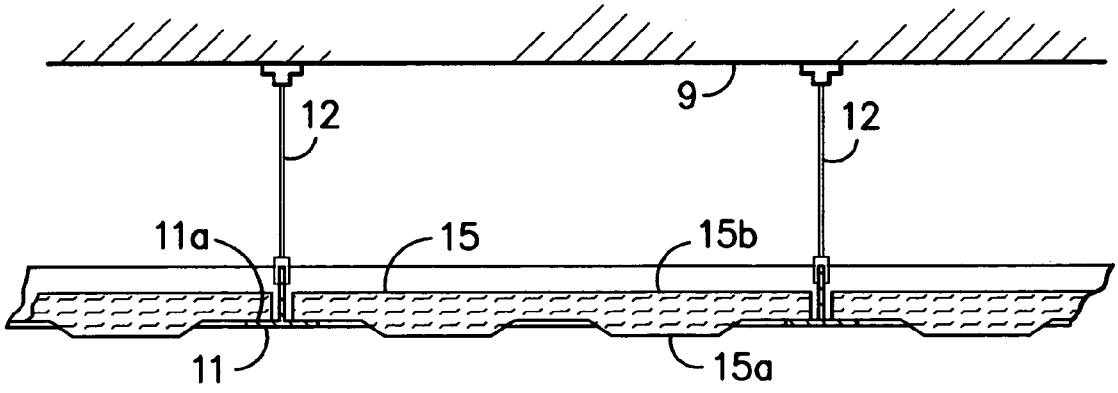
FIG. 2 shows a partial cross sectional view of an embodiment of the present invention.

Referring now to the figures, and in particular to FIGS. 1 and 2, there is shown an embodiment of the present illustrated as the ceiling system 10. The ceiling system 10 generally includes a frame 11 and ceiling panels 15. Suspension connections 12 secure the suspension framework 11 to the ceiling 9, or a structure near the ceiling 9. The framework 11 is positioned below the ceiling and includes an upper horizontal surface 11*a*. Typically, the frame 11 creates a square, or rectangular, opening that the upper horizontal surface 11*a* follows around the periphery of the opening.

The ceiling panels 15 include a lower surface 15*a* and an upper surface 15*b*. The ceiling panels 15 fit within the opening within the frame 11, and the lower surface 15*a* of the ceiling panels 15 rest on the upper horizontal surface 11 a of the frame 11. In the present invention, the ceiling panels comprise a non-woven material.

Figure 3:
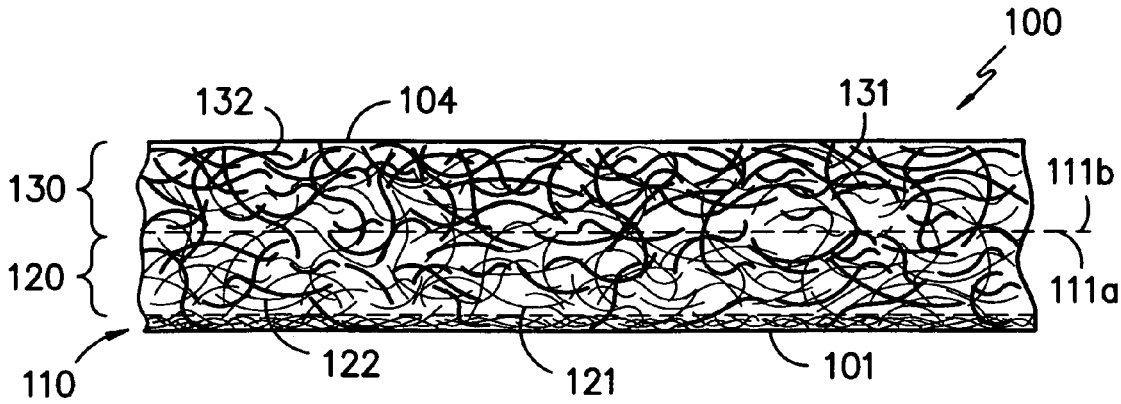
FIG. 3 shows a cross-section of one embodiment of a non-woven material used in the present invention.

Referring now to FIG. 3, there is shown an enlarged cross-sectional view of a non-woven material 100 for use as the ceiling panel 15 in FIGS. 1 and 2. As Illustrated, the non-woven material 100 generally includes first binder fibers 121, first effect fibers 122, second binder fibers 131, and second effect fibers 132. The ceiling panels include a lower surface 15*a* and an upper surface 15*b*.

As used herein, binder fibers are fibers that form an adhesion or bond with the other fibers. Binder fibers can include fibers that are heat activated. Examples of heat activated binder fibers are fibers that can melt at lower temperatures, such as low melt fibers, core and sheath fibers with a lower sheath melting temperature, and the like. In one embodiment, the binder fibers are a polyester core and sheath fiber with a lower melt temperature sheath. A benefit of using a heat activated binder fiber as the second binder fiber 131 in the non-woven material 100, is that the material can be subsequently molded to part shapes for use in automotive hood liners, engine compartment covers, ceiling tiles, office panels, etc.

As used herein, effect fibers are any additional fibers which may be beneficial to have located in the respective zone, or concentrated near the respective surface. These effect fibers may be used to impart color or functionality to the surface. Effective fibers of color can give the nonwoven material the desired aesthetic appearance. These effect fibers can also include performance fibers such as chemical resistant fibers (such as polyphenylene sulfide and polytetrafluoroethylene), moisture resistant fibers (such as polytetrafluoroethylene and topically treated materials like polyester), fire retardant fibers, or others.

As used herein, fire retardant fibers shall mean fibers having a Limiting Oxygen Index (LOI) value of 20.95 or greater, as determined by ISO 4589-1. Types of fire retardant fibers include, but are not limited to, fire suppressant fibers and combustion resistant fibers. Fire suppressant fibers are fibers that meet the LOI by consuming in a manner that tends to suppress the heat source. In one method of suppressing a fire, the fire suppressant fiber emits a gaseous product during consumption, such as a halogenated gas. Examples of fiber suppressant fibers include modacrylic, PVC, fibers with a halogenated topical treatment, and the like. Combustion resistant fibers are fibers that meet the LOI by resisting consumption when exposed to heat. Examples of combustion resistant fibers include silica impregnated rayon such as rayon sold under the mark VISIL®, partially oxidized polyacrylonitrile, polyaramid, para-aramid, carbon, meta-aramid, melamine and the like.

In one embodiment, the second effect fibers 132 are a bulking fiber. Bulking fibers are fibers that provide volume in the z direction of the nonwoven material, which extends perpendicularly from the planar dimension of the non-woven material 100. Types of bulking fibers would include fibers with high denier per filament (5 denier per filament or larger), high crimp fibers, hollow-fill fibers, and the like. These fibers provide mass and volume to the material. Examples of fibers used as second effect fibers 132 include polyester, polypropylene, and cotton, as well as other low cost fibers.

The non-woven material 100 includes a first planar zone 120 and a second planar zone 130. The first planar zone 120 has a first boundary plane 101 located at the outer surface of the non-woven material 100, and a first zone inner boundary plane 111*a* located nearer to the second planar zone 130 than the first boundary plane 101. The second planar zone 130 has a second boundary plane 104 located at the outer surface of the non-woven material 100 and a second zone inner boundary plane 111*b* located nearer to the fire retardant planar zone 120 than the second soundary plane 104. The non-woven material 100 is a unitary material, and the boundaries of the two zones do not represent the delineation of layers, but rather areas within the unitary material. Because the non-woven material 100 is a unitary material, and the first planar zone 120 and the second planar zone 130 are not discrete separate layers joined together, various individual fibers will occur in both the first planar zone 120 and the second planar zone 130. Although FIG. 3 illustrates the first planar zone 120 as being a smaller thickness in the z-direction than the second planar zone 130, the relative thickness of the two zones can be different than as shown.

The first planar zone 120 contains first binder fibers 121, first effect fibers 122, second binder fibers 131, and second effect fibers 132. However, the first planar zone 120 primarily contains the first binder fibers 121 and the first effect fibers 122. As such, the first planar zone 120 can have a greater concentration of the first binder fibers 121 than the second planar zone 130, and the first planar zone 120 can have a greater concentration of the first effect fibers 122 than the second planar zone 130. Additionally, the distribution of the fibers in the first planar zone 120 is such that the concentration of the first binder fibers 121 and the first effect fibers 122 is greater at the first boundary plane 101 of the first planar zone 120 than the first zone inner boundary plane 111*a*. Moreover, it is preferred that the concentration of the first effect fibers 122 and the first binder fibers 121 decreases in a gradient along the z-axis from the first boundary plane 101 to the first zone inner boundary plane 111*a*.

The second planar zone 130 also contains second binder fibers 121, first effect fibers 122, second binder fibers 131, and second effect fibers 133. However, the second planar zone 130 primarily contains the second binder fibers 131 and the second effect fibers 132. As such, the second planar zone 130 can have a greater concentration of the second binder fibers 131 than the first planar zone 120, and the second planar zone 120 can have a greater concentration of the second effect fibers 132 than the first planar zone 120. Furthermore, the distribution of the fibers in the second planar zone 130 is such that the concentration of the second effect fibers 132 is greater at the second boundary plan 104 than the second zone inner boundary plane 111*b*. Additionally, it is preferred that the concentration of the second effect fibers 132 decreases in a gradient along the z-axis from the second boundary plane 104 to the second zone inner boundary plane 111*b*.

In the embodiment of the present invention illustrated in FIG. 3, the non-woven material 100 includes a first surface skin 110 along the first boundary plane 101. The first surface skin 110 contains first binder fibers 121, wherein the first binder fibers 121 are melt bonded into the semi-rigid skin. The first surface skin 110 can also contain the first effect fibers 122, the second binder fiber 131, and the bulking fiber 132. However, the first surface skin 110 will contain lesser amounts of the second binder fiber 131 or the bulking fiber 132 than the first effect fiber 122 or the first binder fiber 121. As used herein a skin shall mean a film-like surface. The skin can be continuous (or non-porous) or discontinuous (porous).

Figure 4:
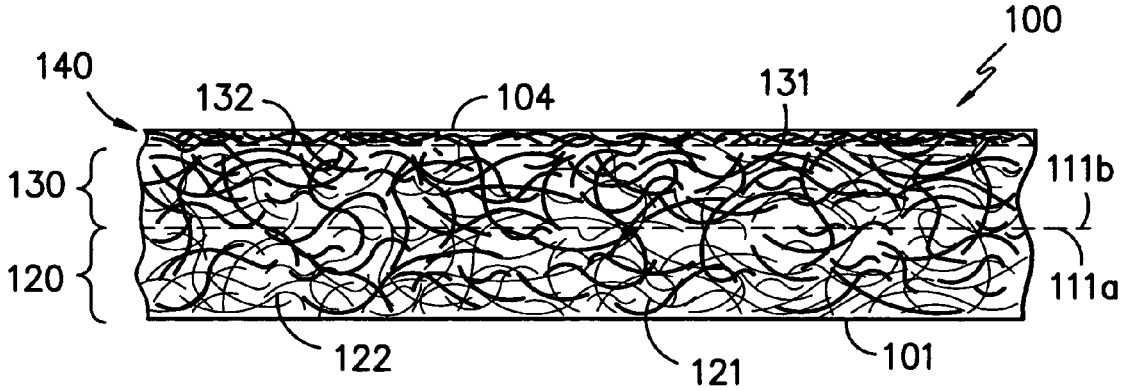
FIG. 4 shows a cross-section of another embodiment of a non-woven material of the present invention.

Referring now to FIG. 4, there is shown a cross-sectional view of another non-woven 200 for use as the ceiling panel 15 in FIGS. 1 and 2. As illustrated, the non-woven material 200 generally includes the first binder fibers 121, the first effect fibers 122, the second binder fibers 131, and the second effect fibers 132, as described with reference to the non-woven 100 in FIG. 3. Also similar to the non-woven material 100, the non-woven material 200 includes first boundary plane 101, a second boundary plane 104, a first planar zone 120, a second planar zone 130, a first zone inner boundary plane 111*a*, and a second zone inner boundary plane 111*b*. The first planar zone 120 in the non-woven material 200 contains the first binder fibers 121, the first effect fibers 122, the second binder fibers 131, and the second effect fibers 132 in the same relative weight, concentrations, and distributions as describe with respect to the first planar zone 120 of the non-woven material 100 in FIG. 3. The second planar zone 130 in the non-woven material 200 contains the first binder fibers 121, the first effect fibers 122, the second binder fibers 131, and the second effect fibers 132 in the same relative weight, concentrations, and distributions as describe with respect to the second planar zone 130 of the non-woven material 100 in FIG. 3. However, the non-woven material 200 does not include the first surface skin 110 as shown with the non-woven material 100 of FIG. 3.

Still referring to FIG. 4, in addition to the common elements that the non-woven material 200 has with the non-woven material 100, the non-woven material also includes a second surface skin 140 along the second boundary plane 104. The second surface skin 140 contains second binder fibers 131, wherein the second binder fibers 131 are melt bonded into the semi-rigid skin. The second surface skin 140 can also contain the second effect fibers 132, the first binder fiber 121, and the first effect fiber 122. However, the second surface skin 140 will contain lesser amounts of the first binder fiber 121 or the first effect fiber 122 than the second binder fiber 131 or the second effect fiber 132.

Figure 5:
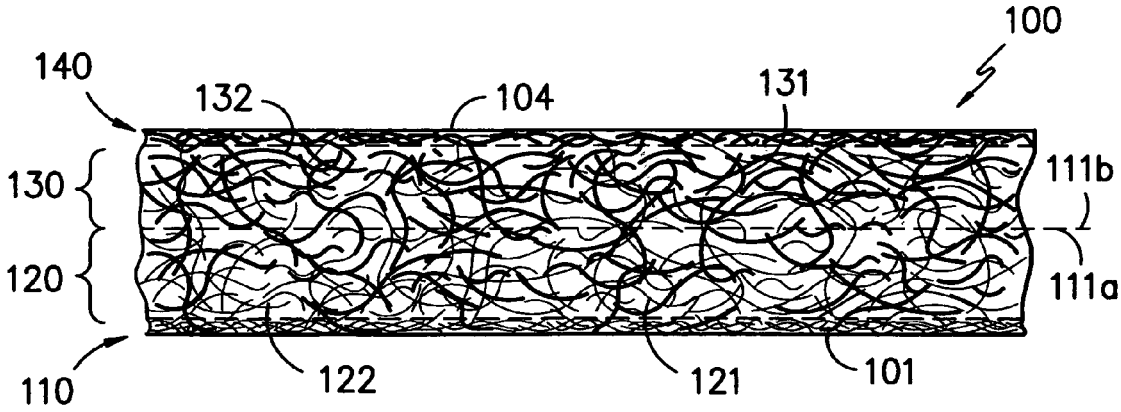
FIG. 5 shows a cross-section of yet another embodiment of a non-woven material of the present invention.

Referring now to FIG. 5, there is shown a cross-sectional view of a yet another non-woven 300 for use as the ceiling panel 15 in FIGS. 1 and 2. As illustrated, the non-woven material 300 generally includes the first binder fibers 121, the first effect fibers 122, the second binder fibers 131, and the second effect fibers 132, as described with reference to the non-woven 100 in FIG. 3. Also similar to the non-woven material 100, the non-woven material 300 includes first boundary plane 101, a second boundary plane 104, a first planar zone 120, a second planar zone 130, a first zone inner boundary plane 111*a*, and a second zone planar inner boundary plane 111*b*. The first planar zone 120 in the non-woven material 300 contains the first binder fibers 121, the first effect fibers 122, the second binder fibers 131, and the second effect fibers 132 in the same relative weight, concentrations, and distributions as describe with respect to the first planar zone 120 of the non-woven material 100 in FIG. 3. The second planar zone 130 in the non-woven material 200 contains the first binder fibers 121, the first effect fibers 122, the second binder fibers 131, and the second effect fibers 132 in the same relative weight, concentrations, and distributions as describe with respect to the second planar zone 130 of the non-woven material 100 in FIG. 3.

Still referring to FIG. 5, in addition to the common elements that the non-woven material 300 has with the non-woven material 100, the non-woven material also includes a first surface skin 110 along the first boundary plane 101 and a second surface skin 140 along the second boundary plane 104. The first surface skin 110 in the non-woven material 300 has the same fibers and properties as the first surface skin 110 in the non-woven material 100 of FIG. 3, and the second surface skin 140 in the non-woven material 300 has the same fibers and properties as the first surface skin 140 in the non-woven material 200 of FIG. 4.

Figure 6:
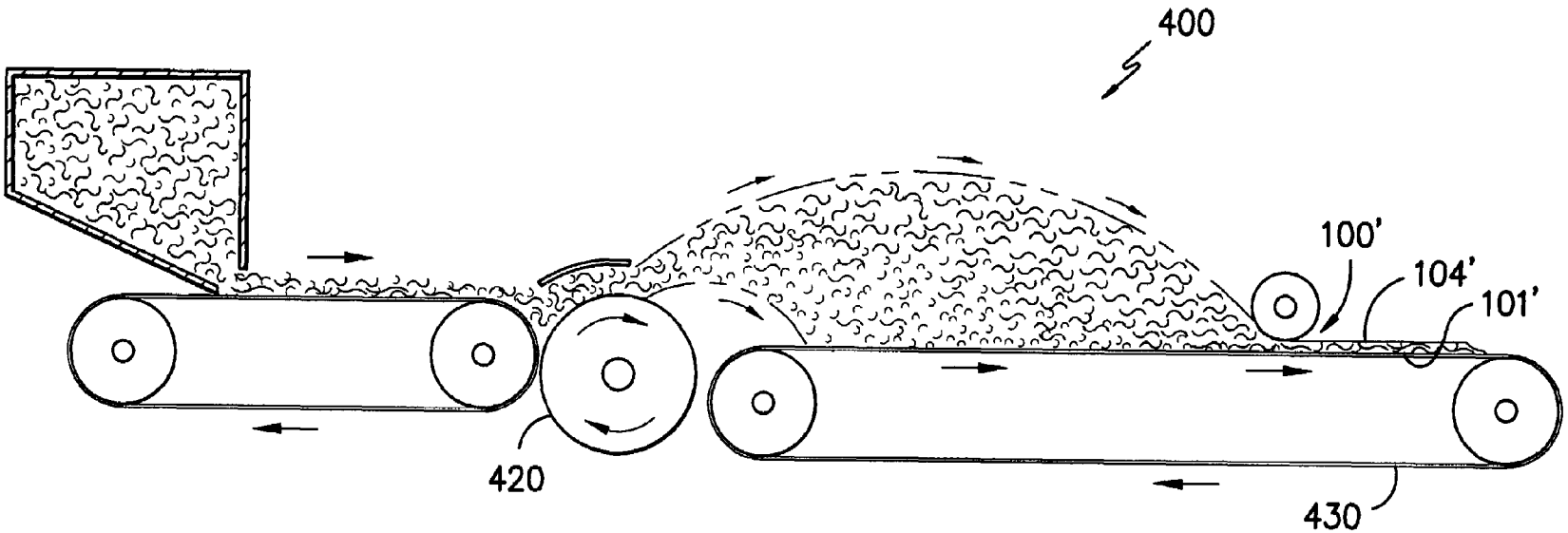
FIG. 6 shows a diagram of a machine for performing a process for forming the non-woven material of the present invention.

Referring now to FIG. 6, there is shown a diagram illustrating a process for forming the non-woven material 100 from FIG. 3, the non-woven material 200 from FIG. 4, or the non-woven material 300 from FIG. 5. As illustrated in FIG. 6, air lay equipment 400 uses differences in the fibers to lay the fibers on a collection belt 430 with the concentration of each type of fiber varying in the z-direction, which is perpendicular to the plane of the non-woven material 100, 200, as it lays on the collection belt 430. A commercially available piece of equipment that has been found satisfactory in this process to form the claimed invention is the "K-12 HIGH-LOFT RANDOM CARD" by Fehrer A G, in Linz, Austria.

Still referring to FIG. 6, in one embodiment, the varying concentration of the fibers in the non-woven material is accomplished by using fibers types having different deniers, which results in the different fibers collecting on the collection belt 430 primarily at different locations. The fibers are projected along the collection belt 430 in the same direction as the travel direction of the collection belt 430. Fibers with a larger denier will tend to travel further than smaller denier fibers down the collection belt 430 before they fall to the collection belt 430. As such, there will tend to be a greater concentration of the smaller denier fibers closer to the collection belt 430 than larger denier fibers. Also, there will tend to be a greater concentration of the larger denier fibers farther from the collection belt 430 than smaller denier fibers.

Referring now to FIGS. 3, 4, 5, and 6, the first binder fibers 121 and the first effect fibers 122 have a smaller denier per filament than the second binder fibers 131 and the second effect fibers 132. It has been found that a good distribution of fibers in the non-woven material can be accomplished by the first binder fibers 121 having a denier ranging from about 1 to about 4 deniers, the first effect fibers 122 having a denier ranging from about 1 to about 4 denier, the second binder fibers 131 having a denier greater than about 4 denier, and the second effect fibers 132 having a denier greater than about 4 denier. Selection of the denier of the various fibers must be such that the difference in the denier between the fibers primarily in the first zone 120 (the first binder fiber 121 and the first effect fiber 122) with the fibers primarily in the bulking zone 130 (the second binder fiber 131 and the bulking fiber 132), is sufficient to create the desired distribution and gradient of the fibers in the non-woven material 100, 200, 300. In one embodiment, the difference between the denier of fibers primarily in bulking zone 130 is at least about two times (2×) the denier or greater than the denier of the fibers primarily in the first zone 120. Preferably, the first binder fiber 121, the first effect fiber 121, the second binder fiber 131, and the second effect fiber 132, are staple fibers having a length of from about 1 inch to about 3.5 inches, and more preferably from about 1.5 inches to about 2.5 inches.

The first binder fibers 121, the first effect fibers 122, the second binder fibers 131, and the second effect fibers 132 are opened and blended in the appropriate proportions and delivered to a cylinder 420. The cylinder 420 rotates and throws the blended fibers towards the collection belt 430 whereby the fibers are collected as they fall from the throwing pattern. The spinning rotation of the cylinder 420 is such that larger denier fibers (the second binder fibers 131 and the second effect fibers 132) tend to travel further than the smaller denier fibers (the first binder fibers 121 and the first effect fibers 122) in the direction of travel for the collection belt 430 before resting on the collection belt 430. Therefore, the web 100' of fibers collected on the collection belt 430 will have greater concentration of the smaller denier fibers (the first binder fibers 121 and the first effect fibers 122) in the z-direction adjacent to the collection belt 430 at the web first surface 101', and a greater concentration of the larger denier fibers (the second binder fibers 131 and the second effect fibers 132) in the z-direction further away from the collection belt 430 at the web second surface 104'.

Inherent in the process of forming the web 100' is the progressive decrease, or gradient, in the concentration of the first binder fibers 121 and the first effect fibers 122, where the concentration of the first binder fibers 121 and the second binder fibers 122 continuously decreases as a function of the distance from the web first surface 101', adjacent to the collection belt 430, moving towards the opposite or web second surface 104'. Also inherent in the process of forming the web 100' is the progressive decrease, or gradient, in the concentration of the second binder fibers 131 and the second effect fibers 132, where the concentration of the second binder fibers 131 and the second effect fibers 132 continuously decreases as a function of the distance from the web second surface 104' moving towards the opposite or web first surface 101'.

After the non-woven web 100' is formed, it can be heated so that the first binder fibers 121 at least partially melt bond with at least a portion of the first effect fibers 122, and so that the second binder fibers 131 are at least partially melt bond with at least a portion of the second effect fibers 132. This heating step stabilizes the non-woven web 100' until the process can be completed to form the non-woven material 100, 200, 300. However, it is contemplated that the heating step to stabilized the non-woven web 101' can be conducted simultaneously with the step of forming of the skin 110 of the non-woven material 100, 200, 300, as disclosed below, by using the same heat source that creates the skin 110.

In the embodiment of the non-woven material 100 illustrated in FIG. 3, the web first surface 101' of the non-woven web 101' is subjected to a heat treatment, such as a calendar or a heated belt, which causes the first binder fibers 121 at the web first surface 101' to fuse together and with the first effect fibers 122 to form a film-like surface or skin. The skin surface formed on the web first surface 101' is first skin 110 of the non-woven material 100. It is to be noted, that the first skin 110 can also be achieved without the use of the first effect fibers 122 in the non-woven web 100', making the first skin 110 primarily formed of the first binder fibers 121. The fusing of material at the first boundary plane 101 to form the first skin 110, creates a non-woven material 100 with reduced air permeability, improved sound absorption, increased abrasion resistance, and increased rigidity as compared to similar material without a fused skin.

In the embodiment of the non-woven material 200 illustrated in FIG. 4, the web second surface 104' of the non-woven web 101' is subjected to a heat treatment, such as a calendar or a heated belt, which causes the second binder fibers 131 at the web second surface 104' to fuse together and with the second effect fibers 132 to form a film-like surface or skin. The skin surface formed on the web second surface 104' is the second skin 140 of the non-woven material 100. It is to be noted, that the second skin 140 can also be achieved without the use of the second effect fibers 132 in the non-woven web 100', making the second skin 140 primarily formed of the second binder fibers 131. The fusing of material at the web second surface 101 to form the second skin 140, creates a non-woven material 200 with reduced air permeability, improved sound absorption, and increased abrasion resistance as compared to similar material without a fused skin.

In the embodiment of the non-woven material 300 illustrated in FIG. 5, the web first surface 101' and the web second surface 104' of the non-woven web 100' are each subjected to a heat treatment, such as a calendar or a heated belt. The heat treatment at the web first surface 101' causes the first binder fibers 121 at the web first surface 101' to fu se together with the first effect fibers 122 to form a film-like surface or skin. The skin surface formed on the web first surface 101' is the first skin 110 of the non-woven material 300. It is to be noted, that the first skin 110 can also be achieved without the use of the first effect fibers 122 in the non-woven web 100', making the second skin 140 primarily formed of the second binder fibers 131. The heat treatment at the web second surface 104' causes the second binder fibers 131 at the web second surface 104' to fuse together and with the second effect fibers 132 to form a film-like surface or skin. The skin surface formed on the web second surface 104' is the second skin 140 of the non-woven material 300. It is to be noted, that the second skin 140 can also be achieved without the use of the second effect fibers 132 in the non-woven web 100', making the second skin 140 primarily formed of the second binder fibers 131. The fusing of material at the web first surface 101' and the web second surface 104' to form the first skin 110 and the second skin 140, respectively, creates a non-woven material 300 with reduced air permeability, improved sound absorption, and increased abrasion resistance as compared to similar material without a fused skin.

Still referring to FIGS. 3, 4, 5, and 6, the web first surface 101' and the web second surface 104' correlate to the first boundary plane 101 and the second boundary plane 104, respectively, of the non-woven material 100, 200, 300. The distribution of the first binder fibers 121, the first effect fibers 122, second binder fibers 131, and the second effect fibers 132 in the non-woven web 101' is the same as the distribution of those same fibers in the non-woven material 100, 200, 300. It is this same distribution of fibers by the equipment 400 that creates the first planar zone 120 and the second planar zone 130 of the non-woven material 100, 200, 300.

In one example of the present invention, the non-woven material was formed from a blend of four fibers, including:

1) about 10% by weight of first binder fiber being from 1 to 2 denier low melt polyester;
2) about 60% by weight of the first effect fibers in the form of fire retardant fibers, including about 20% fire suppressant fiber being 2 denier modacrylic and about 40% fire retardant fiber including both 3.5 denier glass impregnated rayon and 2 denier partially oxidized polyacrylonitrile;
3) about 10% by weight of second binder fibers, being 4 denier and 10 denier low melt polyester; and
4) from about 15% to about 20% by weight of second effect fibers, being 15 denier polyester.

The fibers were opened, blended and formed into non-woven material 100 using a "K-12 HIGH-LOFT RANDOM CARD" by Fehrer A G. Specifically, the fibers are deposited onto the collecting belt of the K-12. After the fibers are collected, the non-woven web is heated to about 160° C. Upon cooling the bonded non-woven web, the web is then calendared on the side of the web containing the greater amount of the first binder fibers and the fire retardant first effect fibers. The calendaring process melt bonds the first binder fibers at first boundary plane 101 of the non-woven web into a semi-rigid skin that becomes a fire retardant skin. The resulting non-woven material had a weight per square yard from about 7 to about 10 ounces. In the resulting non-woven material, the fire retardant first effect fibers make up at least 40% of the non-woven material, and there are at least twice as many first binder fibers and fire retardant first effect fibers as compared with the second effect fibers and second binder fibers.

In a second example of the present invention, the non-woven material was formed from a blend of four fibers, including:

1) about 25% by weight of first binder fibers, being 1 denier low melt polyester fibers;
2) about 20% by weight of second binder fibers, being about equally split between 4 denier low melt polyester fibers and a 10 denier low melt polyester fibers; and
3) about 55% by weight of second effect fibers, being 15 denier polyester second effect fibers.

The fibers were opened, blended and formed into non-woven material 100 using a "K-12 HIGH-LOFT RANDOM CARD" by Fehrer A G. Specifically, the fibers are deposited onto the collecting belt of the K-12. After the fibers are collected, the non-woven web is heated to about 160° C. Upon cooling the bonded non-woven web, the web is then calendared on the side of the web containing the greater amount of the first binder fibers. The calendaring process melt bonds the first binder fibers at first boundary plane of the non-woven web into a semi-rigid skin that becomes the first skin. The resulting non-woven material had a weight per square yard from about 7 to about 10 ounces.

The second example of the present invention was tested for air permeability, sound absorption, and abrasion resistance, and compared to a non-woven with the same materials but no skin layer. Sound Absorption was tested according to ASTM E 1050 (ISO 10534-2), Air Permeability was tested according to ASTM D-737, and Martindale Abrasion was tested according to ASTM D-4966. The results of the testing are shown in the table below, where Article A is the non-woven material without a skin and Article B is the non-woven material with the skin:

TABLE 1

| | Sound Absorption @ | | | Air | Martindale |
|---|---|---|---|---|---|
| Sample | 500 Hz | 1000 Hz | 1500 Hz | Permeability | Abrasion |
| Article A | 15% | 29% | 44% | 198.5 | 5 |
| Article B | 19% | 42% | 64% | 147.0 | 8 |

As can be seen from the results in Table 1, the skin improves sound absorption, reduces air permeability, and improves abrasion resistance.

Typically, the first boundary plane 101 of the non-woven material 100, 200, 300, is a semi-rigid material that has a preferred density from about 7 to 10 ounces per square yard, this weight can vary. For example, the weight of the non-woven material can be from about 6 to about 15 ounces per square yard, from about 15 to about 35 ounces per square yard or from about 7 to about 10 ounces per square yard.

Referring now to FIGS. 1-6, typically, the first boundary plane 101 of the non-woven material 100, 200, 300, is the lower surface 15*a* of the panel 15 that contacts the upper surface 11*a* of the frame 12, however, the second boundary surface 104 of the non-woven material 100, 200, 300, can be the lower surface 15*a* of the panel 15 that contacts the upper surface 11*a* of the frame 11. One preferred embodiment of the present invention for this application is the non-woven material 300, with the first skin 110 and the second skin 140, where the printing can be done on the first skin 110. The first skin 110 and the second skin 140 on opposite sides of the non-woven 300, creates a stronger more resilient composite that can recover up to 85% of its original thickness in the z direction after being compressed.

In one embodiment using the non-woven 100 or the non-woven 300, the first boundary surface 101 is the lower surface 15*a* of the panel 15. The non-woven material 100, 300, for this embodiment preferably has at least one smooth surface suitable for printing. Such a smooth surface can be created by keeping the denier of the first binder fiber 121 as small as possible, and creating the skin 110 on this embodiment for the printing surface. The smaller denier of the first binder fiber 121 allows for tighter packing of the fibers, which will create a more dense, continuous (less porous) skin. A printed pattern is placed upon the first boundary surface 101 with becomes visible below the ceiling system 10. The pattern can be a design that appears as apertures or relief in the panels 15.

In one embodiment of the present invention, the non-woven material 100, 200, 300, has been subjected to a molding process that creates a relief, or three dimensional surface, on the first boundary surface 101 and/or the second boundary surface 102. The three dimensional surface of the non-woven material 100, 200, 300, can be apertures with in the material, or create projecting surfaces or planes from the surface of the material 100, 200, 300. The relief surface is positioned such that it becomes the lower surface 15*a* of the panel 15 which is visible below the ceiling system 10.

Although the present invention has been described in considerable detail with reference to certain preferred versions thereof, other versions are possible. For example, the panels 15 can be mounted directly to the ceiling 9 by fasteners or adhesives, eliminating the need for the framework 11 and the suspension connections 12. In another example, the panels 15 can be suspended from the ceiling 9 using only the suspension connections 12 that connect from the ceiling 9 or structure near the ceiling 9 directly to the panels 15. Therefore, the spirit and scope of the appended claims should not be limited to the description of the preferred versions contained herein.

What is claimed is:

1. A ceiling system comprising:

a suspension framework having a frame, the frame having a plurality of upper horizontal surfaces;

a plurality of panels, the panels comprising a non-woven material having:

first binder fibers, first effect fibers, second binder fibers, and, second effect fibers;

wherein the non-woven material being a unitary material formed in a single process without joining together discrete separate layers having:

a first planar zone defined by a first boundary plane and a first zone inner boundary plane, the first planer zone including a portion of the first binder fibers, the first effect fibers, and the second binder fibers;

a second planar zone defined by a second boundary plane and a second zone inner boundary plane, the second planar zone including a portion of the first binder fibers, the first effect fibers, and the second binder fibers;

a first semi-rigid skin at the first boundary plane formed by melt bonding the first binder fibers on the first boundary plane of the first planar zone, the first skin comprising the first binder fibers;

wherein concentrations of said first binder fibers in said first planar zone being greater than concentrations of the first binder fibers in said second planar zone, and the concentration of the first binder fibers decreases in a gradient from the first boundary plane to the first zone inner boundary plane;

wherein concentrations of said second binder fibers being greater in said second planar zone than the concentration of the second binder fibers in second planar zone, and the concentration of the second binder fibers decreases in a gradient from the second boundary plane to the second zone inner boundary plane; and wherein the first boundary plane of the non-woven material contact the upper horizontal surfaces of the frame in the suspension framework.

* * * * *